US011672061B1

(12) United States Patent
Peng

(10) Patent No.: US 11,672,061 B1
(45) Date of Patent: Jun. 6, 2023

(54) LED LIGHT STRING CONTROL SYSTEM AND METHOD OF CONTROLLING THE SAME

(71) Applicant: SEMISILICON TECHNOLOGY CORP., New Taipei (TW)

(72) Inventor: Wen-Chi Peng, New Taipei (TW)

(73) Assignee: SEMISILICON TECHNOLOGY CORP., New Taipei (TW)

( * ) Notice: Subject to any disclaimer, the term of this patent is extended or adjusted under 35 U.S.C. 154(b) by 0 days.

(21) Appl. No.: 17/827,550

(22) Filed: May 27, 2022

(51) Int. Cl.
*H05B 45/325* (2020.01)
*H05B 47/165* (2020.01)
*H05B 45/46* (2020.01)

(52) U.S. Cl.
CPC ..... *H05B 45/325* (2020.01); *H05B 47/165* (2020.01); *H05B 45/46* (2020.01)

(58) Field of Classification Search
CPC ..... H05B 45/10; H05B 45/165; H05B 45/30; H05B 45/325; H05B 45/46; H05B 47/10
See application file for complete search history.

(56) References Cited

U.S. PATENT DOCUMENTS

2014/0217886 A1* 8/2014 Knoedgen ..... H05B 45/37 315/307

* cited by examiner

*Primary Examiner* — Jimmy T Vu
(74) *Attorney, Agent, or Firm* — Muncy, Geissler, Olds & Lowe, P.C

(57) ABSTRACT

An LED light string control system includes an LED light string, a voltage generation apparatus, and a control module. The control module controls the voltage generation apparatus to change a signal provided to the LED light string to a first voltage level according to a first logic of a light command, and to change the signal to a second to a second voltage level according to a second logic of the light command. The control module controls the voltage generation apparatus to change the signal to a distinction voltage once first logics and/or second logics of the light command appear consecutively.

10 Claims, 6 Drawing Sheets

LED LIGHT STRING CONTROL SYSTEM AND METHOD OF CONTROLLING THE SAME

BACKGROUND

Technical Field

The present disclosure relates to an LED light string control system and a method of controlling the same, and more particularly to an LED light string control system with signal identification function and a method of controlling the same.

Description of Related Art

The statements in this section merely provide background information related to the present disclosure and do not necessarily constitute prior art.

Since the application of light-emitting diodes (LEDs) is becoming more and more popular, and the manufacturing cost thereof is also getting lower and lower, the application of LEDs in lighting or display is becoming more and more extensive. Correspondingly, there are more and more operation and control methods for the lighting behavior of LEDs. In the application of LED light strings, since the previous technology only uses the time width to determine whether the logic signal is "0" or "1", the disadvantage is that in the LED light string, the number of lights, the length of the distance between the lights, and the thickness of the wire diameter of the light string will affect the parasitic capacitive reactance in the LED light string. If the parasitic capacitance is too large, the square wave waveform of "0" and "1" will be distorted.

It is assumed that the square-wave waveform of "0" and "1" should last for 1 μs under ideal conditions, and the LED light string needs to last at least 0.8 μs to identify this signal as "0" or "1". However, due to the distortion by influence of too large parasitic capacitance, the square-wave waveform with logic "0" is only 0.5 μs. Therefore, if the square-wave waveform is distorted, only using the time width to determine the logic signal may easily lead to insufficient time width and misjudgment, which in turn leads to the situation that the LED light string cannot be controlled.

SUMMARY

An object of the present disclosure is to provide an LED light string control system to solve problems of the existing technology. The LED light string control system includes an LED light string, a voltage generation apparatus, and a control module. The LED light string includes at least one LED module. The voltage generation apparatus is coupled to the LED light string. The control module is coupled to the voltage generation apparatus, and controls the voltage generation apparatus to change a signal provided to the LED light string to a first voltage level according to a first logic of a light command, and changes the signal to a second voltage level according to a second logic of the light command. The light command is composed of the plurality of first logics and the plurality of second logics. The control module controls the voltage generation apparatus to change the signal to the second voltage level as a distinction voltage level to distinguish the two consecutive first voltage levels once the first logics of the light command appear consecutively, and/or the control module controls the voltage generation apparatus to change the signal to the first voltage level as the distinction voltage level to distinguish the two consecutive second voltage levels once the second logics of the light command appear consecutively. The at least one LED module correspondingly generates a drive command according to the plurality of first voltage levels and the plurality of second voltage levels except the distinction voltage level so as to generate lighting behavior according to the drive command. The distinction voltage has a first time width, the first voltage level has a second time width, and the second voltage level has a third time width; the first time width is different from the second time width and the third time width.

Another object of the present disclosure is to provide a method of controlling an LED light string control system to solve problems of the existing technology. The method includes steps of: changing a signal received by an LED light string to a first voltage level according to a first logic of a light command, changing the signal to a second voltage level according to a second logic of the light command, changing the signal to the second voltage level as a distinction voltage level for distinguishing two consecutive first voltage levels once first logics of the light command appear consecutively, and/or changing the signal to the first voltage level as the distinction voltage level VI for distinguishing two consecutive second voltage levels once second logics of the light command appear consecutively, and generating a drive command, by at least one LED module of the LED light string, corresponding to the plurality of first voltage levels and the plurality of second voltage levels except the distinction voltage levels so as to generate lighting behavior according to the drive command. The light command is composed of the plurality of first logics and the plurality of second logics; the distinction voltage level has a first time width, the first voltage level has a second time width, and the second voltage level has a third time width; the first time width is different from the second time width and the third time width.

The main purpose and effect of the present disclosure are: since the LED light string control system determines the logic signal of "0" or "1" according to the signal level, instead of only determining the logic signal according to the time width, it is not necessary to wait for the full/complete time width of a specific logic before determining that the logic of "0" or "1", and it will not cause the logic to be unidentifiable due to waveform distortion, which can significantly reduce the transmission time and determination time of the light command.

It is to be understood that both the foregoing general description and the following detailed description are exemplary, and are intended to provide further explanation of the present disclosure as claimed. Other advantages and features of the present disclosure will be apparent from the following description, drawings and claims.

BRIEF DESCRIPTION OF DRAWINGS

The present disclosure can be more fully understood by reading the following detailed description of the embodiment, with reference made to the accompanying drawing as follows.

DETAILED DESCRIPTION

Figure 1:
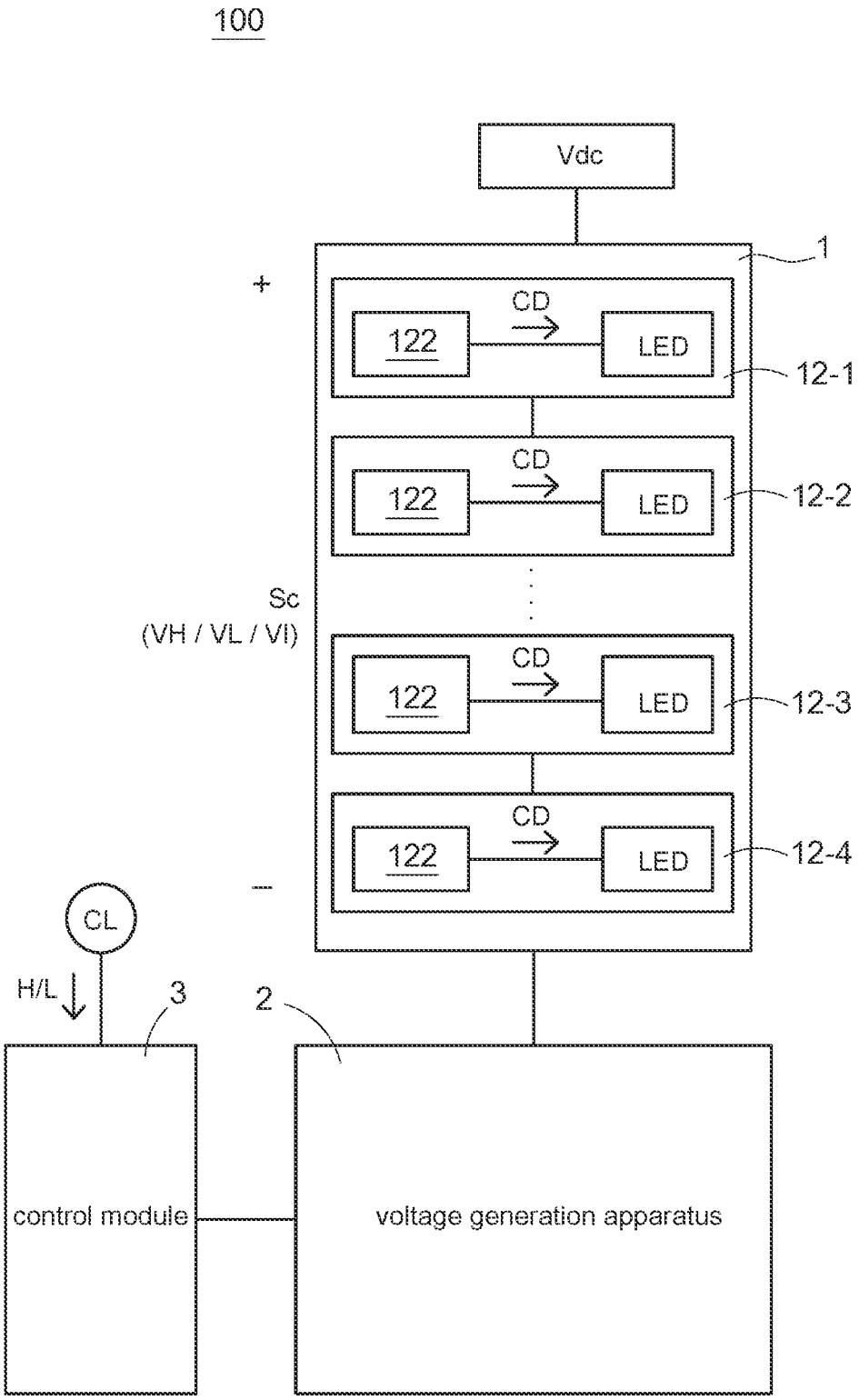
FIG. 1 is a block circuit diagram of an LED light string control system with signal identification function according to the present disclosure.

Reference will now be made to the drawing figures to describe the present disclosure in detail. It will be understood that the drawing figures and exemplified embodiments of present disclosure are not limited to the details thereof.

Please refer to FIG. 1, which shows a block circuit diagram of an LED light string control system with signal identification function according to the present disclosure. The LED (light-emitting diode) light string control system 100 receives a DC (direct-current) voltage Vdc. The LED light string control system 100 includes a LED light string 1, a voltage generation apparatus 2, and a control module 3. The LED light string 1 receives the DC voltage Vdc, and the LED light string 1 includes at least one LED module 12-1 to 12-4 (in this embodiment, four LED modules are illustrated). The voltage generation apparatus 2 is coupled to the LED light string 1, and the control module 3 is coupled to the voltage generation apparatus 2. The control module 3 controls the voltage generation apparatus 2 to generate a specific voltage according to a light command CL so that the DC voltage Vdc is affected by the specific voltage to change a signal Sc received at both ends of the LED light string 1. Each LED module 12-1 to 12-4 includes a controller 122 and at least one LED LED, and the controller 122 controls the lighting behavior of the LED LED according to the signal Sc.

Specifically, the light command CL usually includes a logic signal composed of "0" and "1", and is mainly a specific command in which "0" and "1" are arranged and combined in a specific order, for example, but not limited to "11010". By coding the logic signal, the specific LED modules 12-1 to 12-4 can be designated to generate a specific lighting behavior. For example, but not limited to "00" and "101" designate the lighting behavior of the LED module 12-1 (corresponding to "00") to flicker (corresponding to "101"). The controller 122 of the LED module 12-1 to 12-4 can realize the lighting behavior to be generated by itself according to a specific signal segment in the logic signal. That is, the logic signal includes at least one signal segment, and each LED module 12-1 to 12-4 correspondingly captures the signal segment to which it belongs so as to generate lighting behavior accordingly. The control module 3 changes the signal Sc at both ends of the LED light string 1 according to the light command CL so that the controller 122 of the LED module 12-1 to 12-4 realizes the lighting behavior that must be generated by yourself, and control the LED LED accordingly.

Furthermore, the light command CL includes a first logic H (for example, but not limited to "1") and a second logic L (for example, but not limited to "0"). Preferably, the light command CL may be composed of a plurality of first logics H, a plurality of second logics L or a combination of the two according to actual needs. In particular, the present disclosure takes the combination of the two as the main embodiment, but is not actually limited to this. The control module 3 controls the voltage generation apparatus 2 to generate a first specific voltage according to the first logic H so as to change the signal Sc to a first voltage level VH (for example, but not limited to a high-level signal) corresponding to a voltage difference between the DC voltage Vdc and the first specific voltage. The control module 3 controls the voltage generation apparatus 2 to generate a second specific voltage according to the second logic L so as to change the signal Sc to a second voltage level VL (for example, but not limited to a low-level signal) corresponding to a voltage difference between the DC voltage Vdc and the second specific voltage. In an embodiment of the present disclosure, the above-mentioned logics, signals and their corresponding relationships are merely examples, and are not limited thereto.

Since the LED light string control system 100 determines the logic signal of "0" or "1" according to the signal level, instead of only determining the logic signal according to the time width, if there are consecutive first logics H or consecutive second logics L, it must be distinguished to prevent the consecutive logics from being determined as a single logic. Therefore, once the consecutive first logics H of the light command CL appear, the control module 3 controls the voltage generation apparatus 2 to change the signal Sc to the second voltage level VL as a distinction voltage VI to distinguish the two consecutive first voltage levels VH. Similarly, cone the second logics L of the light command CL appear consecutively, the control module 3 controls the voltage generation apparatus 2 to change the signal Sc to the first voltage level VH as the distinction voltage VI to distinguish the two consecutive second voltage levels VL. The control module 3 may directly control the voltage generation apparatus 2 to change the signal Sc to the corresponding distinction voltage VI when two consecutive identical logics are detected. It is also possible to generate distinction logic for distinguishing between two identical logics after detecting two consecutive identical logics, and then control the voltage generation apparatus 2 to change the signal Sc to the distinction voltage VI, which is different from the first voltage level VH and the second voltage level VL. Therefore, the controller 122 of the LED modules 12-1 to 12-4 may correspondingly generate the drive command CD according to the plurality of first voltage levels VH and second voltage levels VL (the distinction voltage VI is only used for distinction) to control the LED LED to generate lighting behavior according to the drive command CD. In one embodiment, the LED modules 12-1 to 12-4 are coupled in series, but they may also be coupled in parallel (not shown).

On the other hand, since the difference between the distinction voltage level VI, the first voltage level VH, and the second voltage level VL must be clearly identified, in addition to using the voltage level to determine the logic signal of "0" or "1", it is also necessary to use time width to clearly identify the voltage level difference. Specifically, the distinction voltage level VI has a first time width, the first voltage level VH has a second time width, and the second voltage level VL has a third time width. The control module 3 controls the voltage generation apparatus 2 to change the first time width, the second time width, and the third time width according to the light command CL to make the first time width be different from the second time width and the third time width so that the distinction voltage level VI, the first voltage level VH, and the second voltage level VL can be clearly identified.

The main purpose and effect of the present disclosure are: since the LED light string control system 100 determines the logic signal of "0" or "1" according to the signal level, instead of only determining the logic signal according to the time width, it is not necessary to wait for the full/complete time width of a specific logic before determining that the logic of "0" or "1", and it will not cause the logic to be unidentifiable due to waveform distortion, which can significantly reduce the transmission time and determination time of the light command CL.

Figure 2:
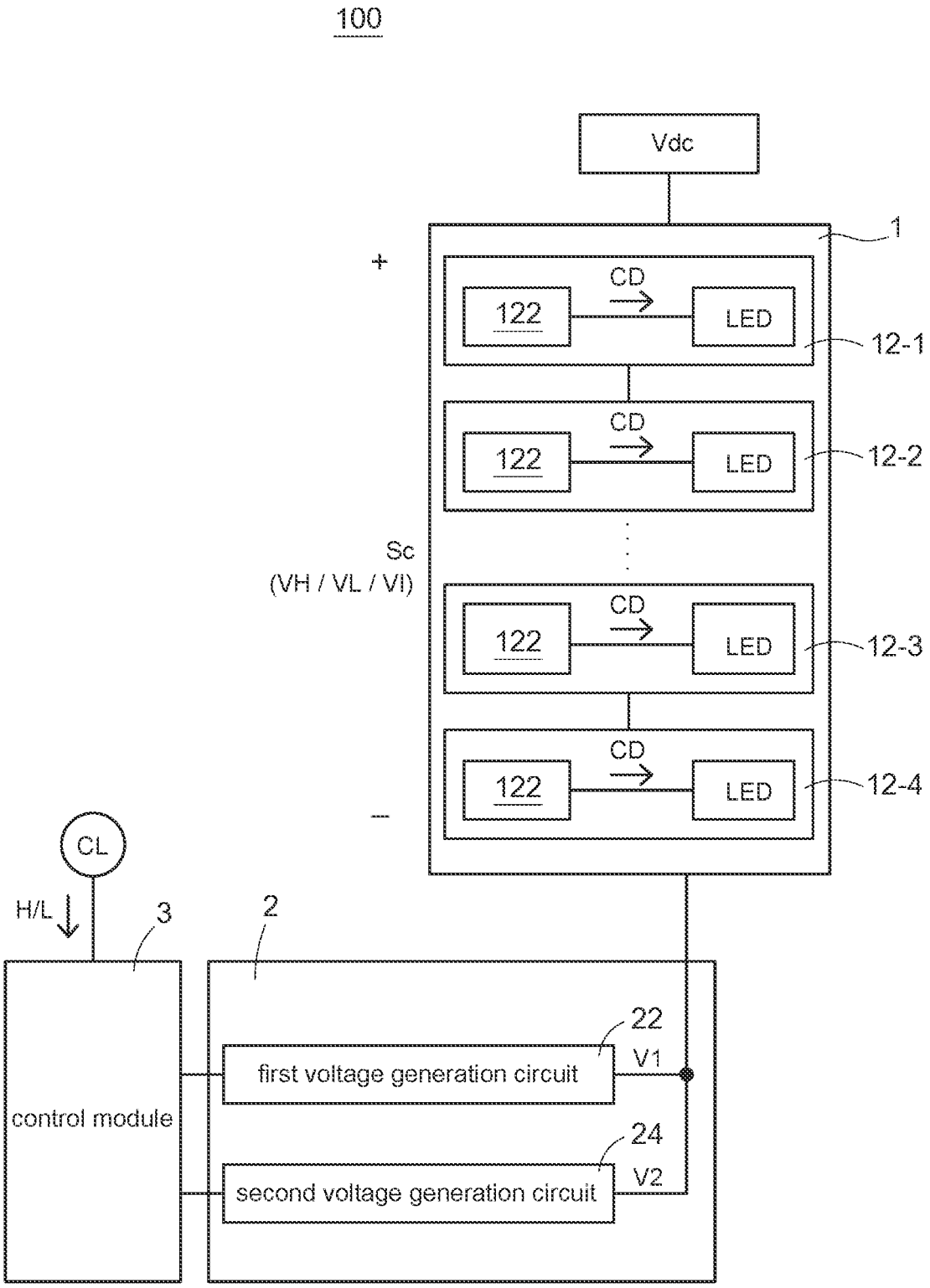
FIG. 2 is a block circuit diagram of a voltage generation apparatus according to the present disclosure.

Please refer to FIG. 2, which shows a block circuit diagram of a voltage generation apparatus according to the present disclosure, and also refer to FIG. 1. The voltage generation apparatus 2 includes a first voltage generation circuit 22 and a second voltage generation circuit 24. The first voltage generation circuit 22 and the second voltage generation circuit 24 are coupled to the LED light string 1 and the control module 3. When the light command CL is the first logic H, the control module 3 controls the first voltage generation circuit 22 to generate a first voltage V1 according to the first logic H so as to change the signal Sc to the first voltage level VH. When the light command CL is the second logic L, the control module 3 controls the second voltage generation circuit 24 to generate a second voltage V2 according to the second logic L so as to change the signal Sc to the second voltage level VL.

The control module 3 generates the reversed second voltage level VL or the first voltage level VH according to the consecutive first logics H or the consecutive second logics L. The control module 3 controls the second voltage generation circuit 24 to generate the second voltage V2 according to the consecutive first logics H of the light command CL to make the second voltage V2 as the distinction voltage level VI. Therefore, the consecutive first logics H may be distinguished to avoid being misjudged as a single logic. Similarly, the control module 3 controls the first voltage generation circuit 22 to generate the first voltage V1 according to the consecutive second logics L of the light command CL to make the first voltage V1 as the distinction voltage level VI. Therefore, the consecutive second logics L may be distinguished to avoid being misjudged as a single logic. In particular, in order to prevent the distinction voltage level VI from being misjudged as the first voltage level VH or the second voltage level VL, the distinction voltage level VI needs to be distinguished from the first voltage level VH and the second voltage level VL.

Specifically, the control module 3 preferably distinguish the distinction voltage level VI from the first voltage level VH and the second voltage level VL with a time width. Therefore, the control module 3 sets the first time width of the distinction voltage level VI, the second time width of the first voltage level VH, and the third time width of the second voltage level VL. The control module 3 sets and limits the first time width to be smaller than the second time width and the third time width respectively, or sets and limits the first time width to be greater than the second time width and the third time width respectively, or sets and limits the second time width and the third time width to be the same or different. For the transmission time, it is a preferred embodiment that the first time width is smaller than the second time width and the third time width respectively.

In one embodiment, the control module 3 may include a controller, which may be a controller composed of components such as circuits (such as operational amplifiers, resistors, capacitors, etc.), logic gates, or a programmable microcontroller. The control module 3 may also include a detection unit (not shown) for detecting the voltage/current of each point at the LED light string control system 100 so as to stabilize the overall system by manners of detection and feedback.

Figure 3A:
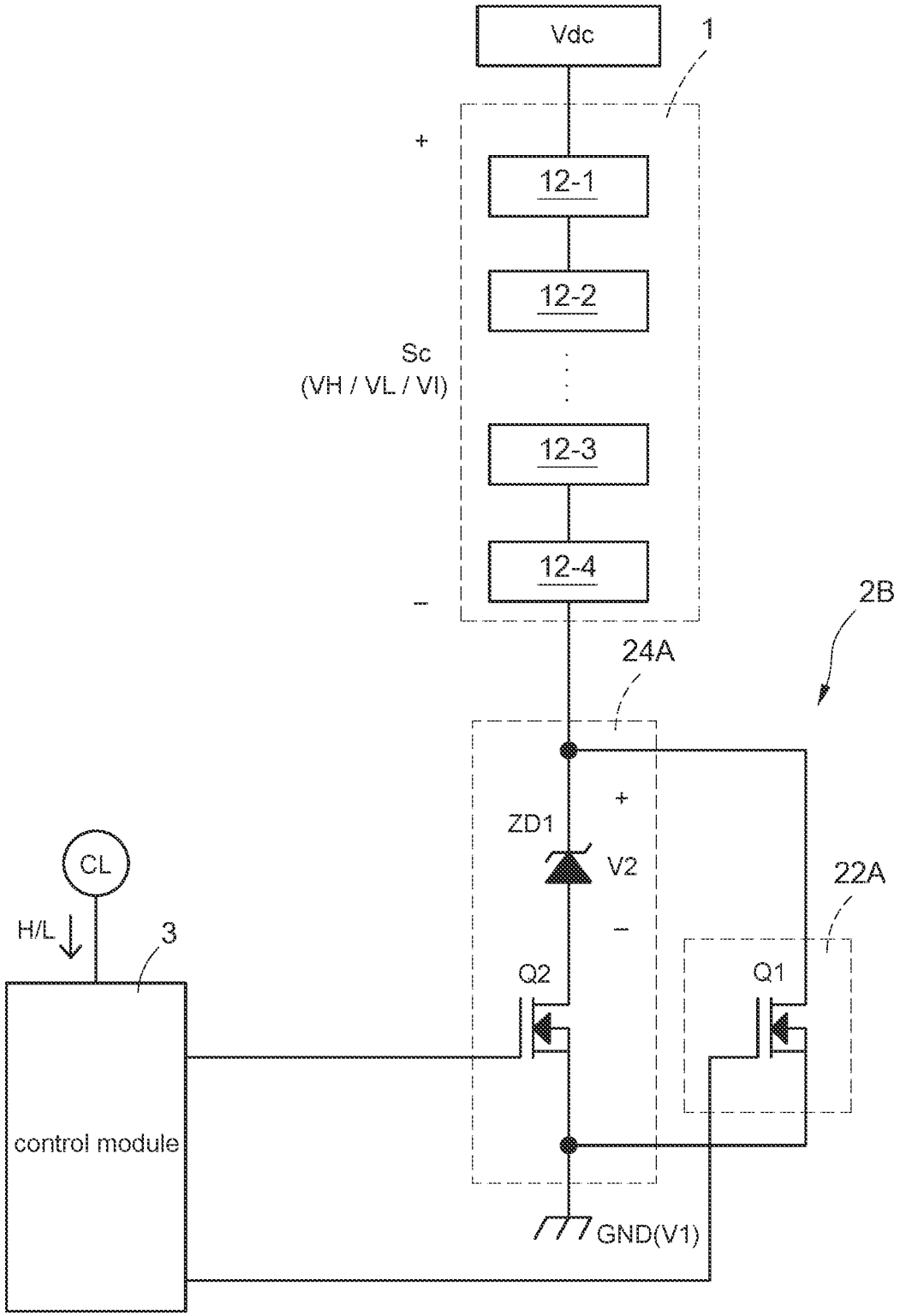
FIG. 3A is a detailed block circuit diagram of the LED light string control system according to a first embodiment of the present disclosure.
Figure 3B:
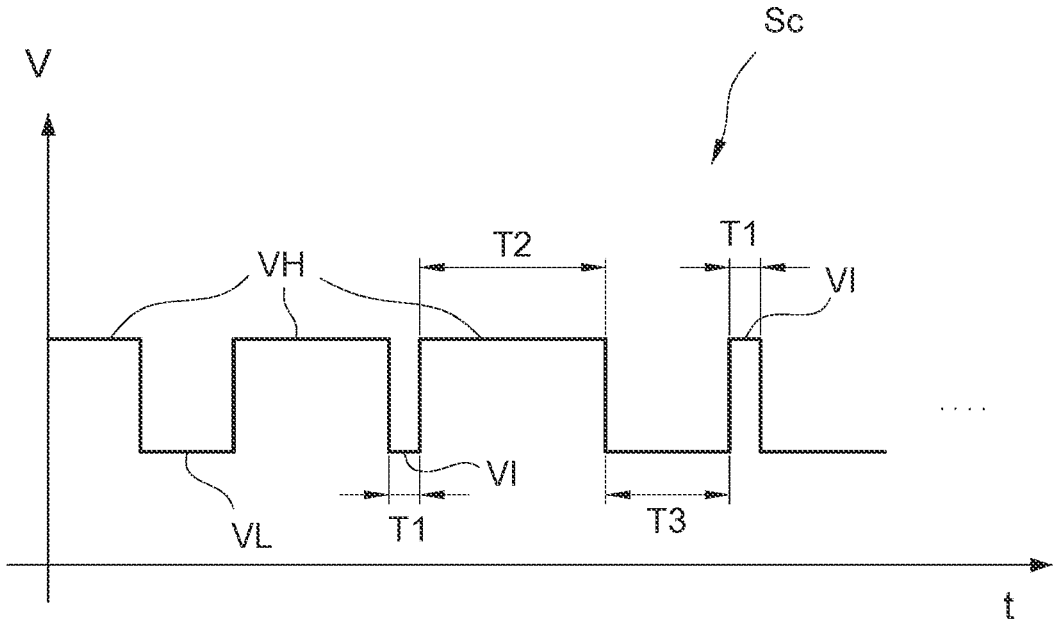
FIG. 3B is a schematic waveform of a signal of the LED light string control system shown in FIG. 3A.

Please refer to FIG. 3A, which shows a detailed block circuit diagram of the LED light string control system according to a first embodiment of the present disclosure, and refer to FIG. 3B, which shows a schematic waveform of a signal of the LED light string control system shown in FIG. 3A, and also refer to FIG. 1 and FIG. 2. In the voltage generation apparatus 2B, the first voltage generation circuit 22A includes a first switch Q1. The first switch is coupled to the LED light string 1 and a ground point GND, and a control end of the first switch Q1 is coupled to the control module 3. When the light command CL is the first logic H, the control module 3 turns on the first switch Q1 to make one end of the LED light string 1 be grounded. In this condition, one end of the LED light string 1 is grounded and the other end thereof receives the DC voltage Vdc, and therefore a voltage level of the ground point GND, for example, but not limited to zero volt is the first voltage V1, and the signal Sc (i.e., the first voltage level VH) of the LED light string 1 is the DC voltage Vdc (refer to FIG. 3B). On the contrary, when the light command CL is not the first logic H, the control module 3 turns off the first switch Q1 to disconnect a path of the first voltage generation circuit 22A.

The second voltage generation circuit 24A is connected to the first voltage generation circuit 22A in parallel. The second voltage generation circuit 24A includes a first regulation component ZD1 and a second switch Q2. The first regulation component ZD1 is coupled to the LED light string 1. The second switch Q2 is coupled to the first regulation component ZD1 and the ground point GND, and a control end of the second switch Q2 is coupled to the control module 3. When the light command CL is the second logic L, the control module 3 turns on the second switch Q2 so that the first regulation component ZD1 generates the second voltage V2 due to the turned-on second switch Q2. In this condition, one end of the LED light string 1 receives the second voltage V2, and the other end thereof receives the DC voltage Vdc, and therefore the signal Sc (i.e., the second voltage level VL) is changed to the DC voltage Vdc minus the second voltage V2 (refer to FIG. 3B). For example, when the second switch Q2 is turned on, the first regulation component ZD1 generates the second voltage V2 of 30 volts, the second voltage level VL is the DC voltage Vdc (assuming 100 volts) minus 30 volts. On the contrary, when the light command CL is not the second logic L, the control module 3 turns off the second switch Q2 so that a path of the second voltage generation circuit 24A is disconnected. In particular, the first regulation component ZD1 may be, for example, but not limited to, a Zener diode, or any component and any circuit that may be used for voltage regulation should be included in the scope of the present disclosure.

Moreover, when the light command CL is the consecutive first logics H, the control module 3 turns on the second switch Q2 so that the second voltage V2 generated from the first regulation component ZD1 is as the distinction voltage level VI. On the contrary, when the light command CL is the consecutive second logics L, the control module 3 turns on the first switch Q1 so that the first voltage V1 (i.e., the DC voltage Vdc) is as the distinction voltage level VI. In particular, the time width (i.e., the first time width T1) of the first voltage V1 and the second voltage V2 as the distinction voltage level VI is approximately the second time width T2 of the first voltage level VH (or the third time width T3 of the second voltage level VL) of ⅕ to 1/10 so as to distinguish and avoid misjudgment.

Figure 4:
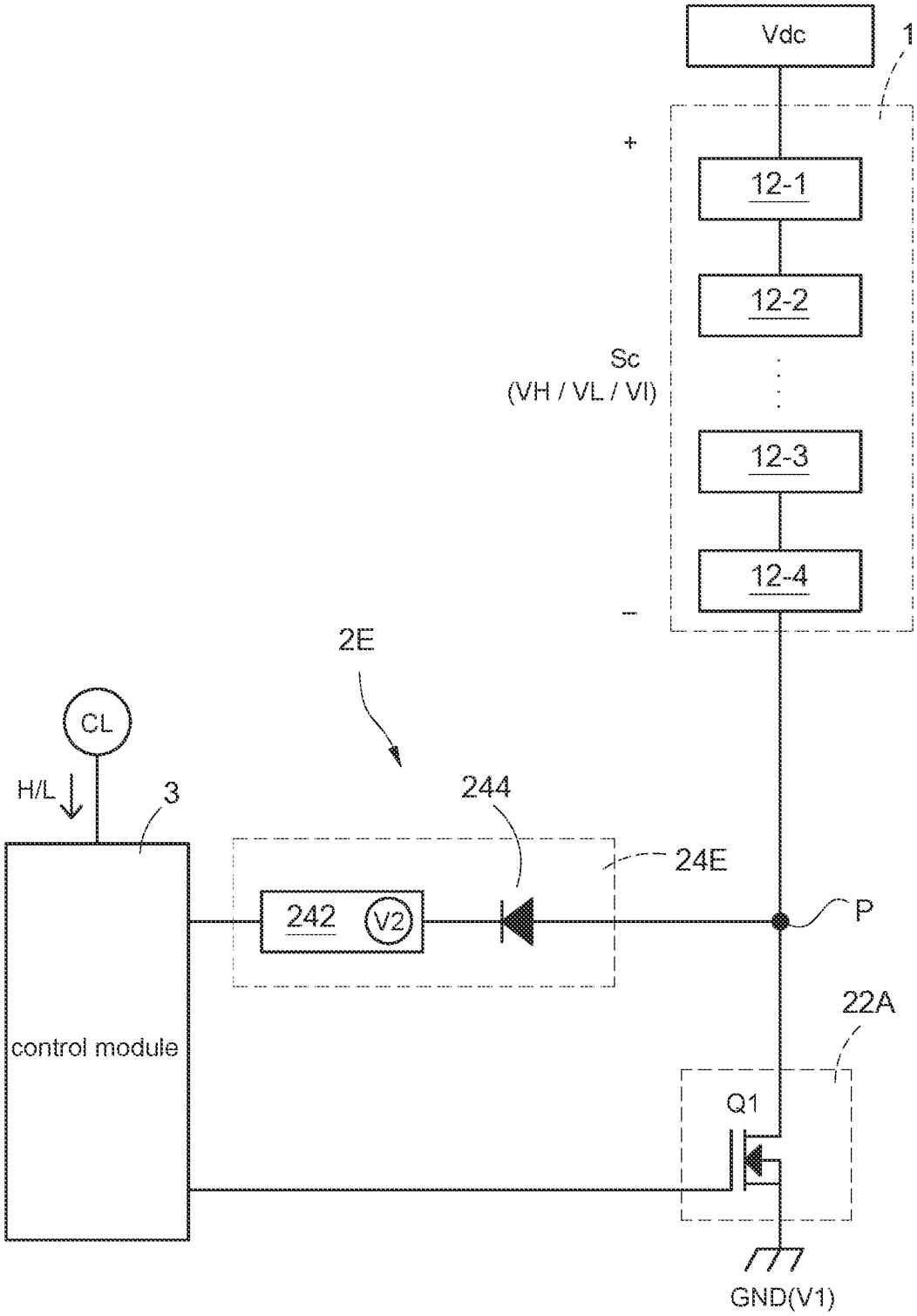
FIG. 4 is a detailed block circuit diagram of the LED light string control system according to a second embodiment of the present disclosure.

Please refer to FIG. 4, which shows a detailed block circuit diagram of the LED light string control system according to a second embodiment of the present disclosure, and also refer to FIG. 1 to FIG. 3B. The difference between the voltage generation apparatus 2E shown in FIG. 4 and the voltage generation apparatus 2B shown in FIG. 3A is that the voltage generation apparatus 2E includes a first voltage generation module 242 and a first unidirectional conduction component 244. The first voltage generation module 242 is coupled to a node P between the LED light string 1 and the first switch Q1 of the first voltage generation circuit 22A. The first unidirectional conduction component 244 is coupled between the node P and the first voltage generation module 242. The control module 3 is coupled to the first voltage generation module 242, and the first unidirectional conduction component 244 is used for unidirectional conduction (connection) of the path from the node P to the first voltage generation module 242. In one embodiment, the first voltage generation module 242 is, for example, but not limited to a voltage generator. Any apparatus, circuit, component that can be used to generate a specific voltage source based on the control of the control module 3 should be included in the scope of the present disclosure.

The method of controlling the LED light string control system is similar to FIG. 3A. When the light command CL is the second logic L, the control module 3 controls the first voltage generation module 242 to generate the second voltage V2 according to the second logic L so that the signal Sc (i.e., the second voltage level VL) is changed to the DC voltage Vdc minus the second voltage V2. On the contrary, when the light command CL is not the second logic L, the first voltage generation module 242 does not work and does not generate the second voltage V2. When the light command CL is the consecutive first logics H or the consecutive second logics L, the control module 3 controls the first voltage generation module 242 to generate the second voltage V2 or turns on the first switch Q1 due to the consecutive first logics H or the consecutive second logics L so that the signal Sc (i.e., the distinction voltage level VI) is changed to the DC voltage Vdc minus the second voltage V2 or the ground voltage of the ground point GND. In one embodiment, the components, the coupling relationship between the components, and the operation manners not described in FIG are all the same as those in FIG. 3A, and the detailed description is omitted here for conciseness. In one embodiment, the first unidirectional conduction component 244 is, for example, but not limited to a diode. Any component that can be used for unidirectional conduction (such as but not limited to a thyristor, etc.) should be included in the scope of the present disclosure.

Figure 5:
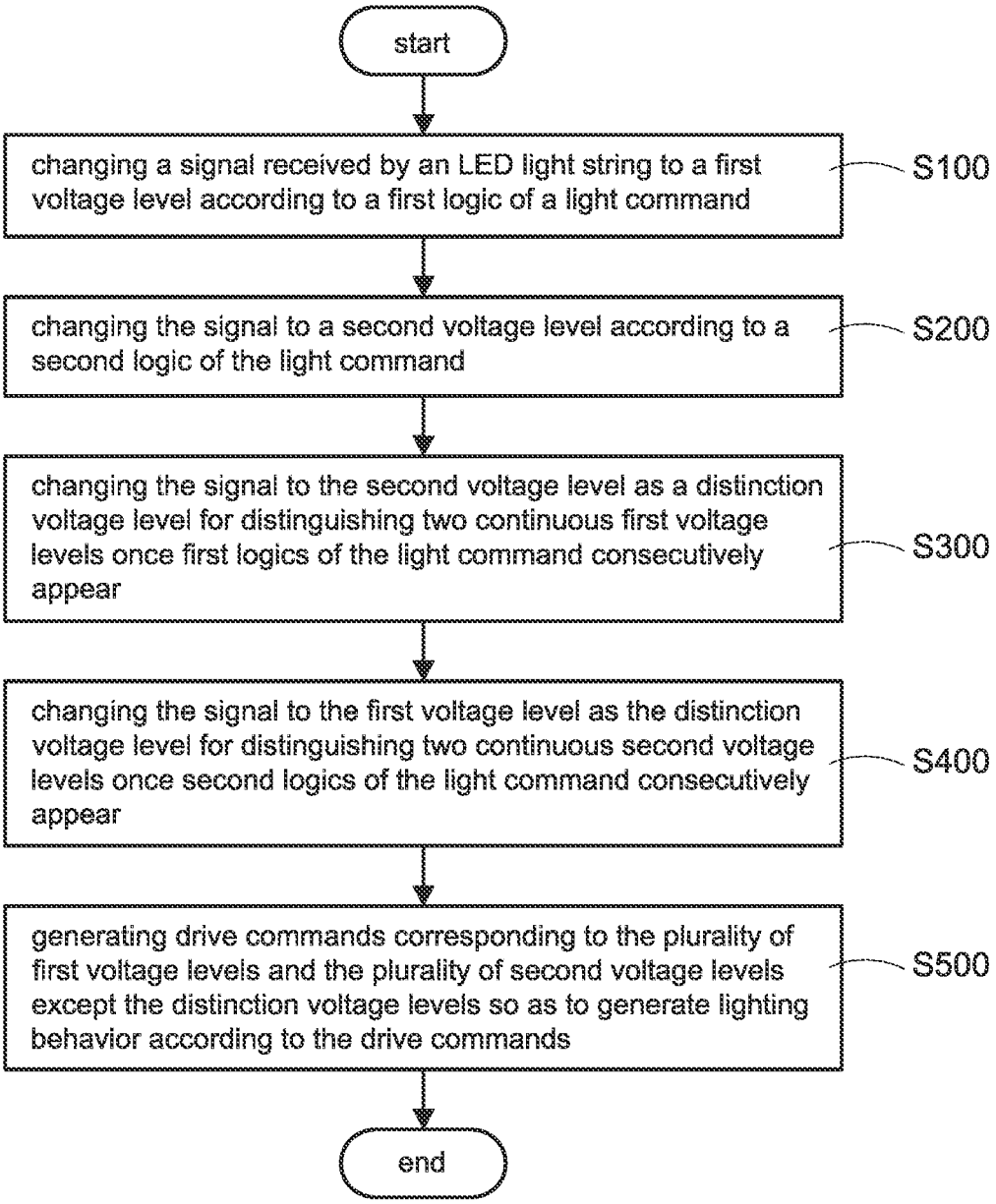
FIG. 5 is a flowchart of a method of controlling the LED light string control system according to the present disclosure.

Please refer to FIG. 5, which shows a flowchart of a method of controlling the LED light string control system according to the present disclosure, and also refer to FIG. 1 to FIG. 4. The method of controlling the LED light string control system 100 is mainly to determine the logic signal of "0" or "1" by the signal level, instead of the time width. The method includes steps of: changing a signal received by an LED light string to a first voltage level according to a first logic of a light command (S100). In one embodiment, a control module 3 controls a voltage generation apparatus 2 to generate a first specific voltage according to the first logic H so as to change the signal Sc to a first voltage level VH (for example, but not limited to a high-level signal) corresponding to a voltage difference between a DC voltage Vdc and the first specific voltage. Afterward, changing the signal to a second voltage level according to a second logic of the light command (S200). In one embodiment, the control module 3 controls the voltage generation apparatus 2 to generate a second specific voltage according to the second logic L so as to change the signal Sc to a second voltage level VL (for example, but not limited to a low-level signal) corresponding to a voltage difference between the DC voltage Vdc and the second specific voltage.

Afterward, changing the signal to the second voltage level as a distinction voltage level for distinguishing two consecutive first voltage levels oncefirst logics of the light command appear consecutively (S300). In one embodiment, the control module 3 may control the second voltage generation circuit 24 shown in FIG. 2 to change the signal Sc to the distinction voltage level VI (i.e., the second voltage level VL) opposite to the first voltage level VH. Afterward, changing the signal to the first voltage level as the distinction voltage level for distinguishing two consecutive second voltage levels once second logics of the light command appear consecutively (S400). In one embodiment, the control module 3 may control the first voltage generation circuit 22 shown in FIG. 2 to change the signal Sc to the distinction voltage level VI (i.e., the first voltage level VH) opposite to the second voltage level VL. Finally, generating drive commands, by the LED modules, corresponding to the plurality of first voltage levels and the plurality of second voltage levels except the distinction voltage levels so as to generate lighting behavior according to the drive commands (S500). In one embodiment, controllers 122 of the LED modules 12-1 to 12-4 are used to correspondingly generate the drive commands CD according to the first voltage levels VH, the second voltage levels VL, and the distinction voltage levels VI to control the at least one LED LED to control the lighting behavior of the at least one LED LED according to the drive commands CD. In one embodiment, the detailed operations of steps (S100) to (S400) depend on the internal circuit structure of the LED light string control system 100, which may be referred to FIG. 3A and FIG. 4, and the detailed description is omitted here for conciseness.

Although the present disclosure has been described with reference to the preferred embodiment thereof, it will be understood that the present disclosure is not limited to the details thereof. Various substitutions and modifications have been suggested in the foregoing description, and others will occur to those of ordinary skill in the art. Therefore, all such substitutions and modifications are intended to be embraced within the scope of the present disclosure as defined in the appended claims.

What is claimed is:

1. An LED light string control system, comprising:

an LED light string, comprising at least one LED module, a voltage generation apparatus, coupled to the LED light string, and a control module, coupled to the voltage generation apparatus, and configured to control the voltage generation apparatus to change a signal provided to the LED light string to a first voltage level according to a first logic of a light command, and to change the signal to a second voltage level according to a second logic of the light command, wherein the light command is composed of the plurality of first logics and the plurality of second logics; the control module controls the voltage generation apparatus to change the signal to the second voltage level as a distinction voltage level to distinguish the two consecutive first voltage levels once the first logics of the light command appear consecutively, and/or the control module controls the voltage generation apparatus to change the signal to the first voltage level as the distinction voltage level to distinguish the two consecutive second voltage levels once the second logics of the light command appear consecutively; the at least one LED module correspondingly generates a drive command according to the plurality of first voltage levels and the plurality of second voltage levels except the distinction voltage level so as to generate lighting behavior according to the drive command, wherein the distinction voltage has a first time width, the first voltage level has a second time width, and the second voltage level has a third time width; the first time width is different from the second time width and the third time width.

2. The LED light string control system as claimed in claim 1, wherein the voltage generation apparatus comprises:

a first voltage generation circuit, coupled to the LED light string and the control module, and a second voltage generation circuit, coupled to the LED light string and the control module, wherein the control module controls the first voltage generation circuit to generate a first voltage to change the signal to the first voltage level, and the control module controls the second voltage generation circuit to generate a second voltage to change the signal to the second voltage level.

3. The LED light string control system as claimed in claim 2, wherein the first time width is less than the second time width.

4. The LED light string control system as claimed in claim 2, wherein the first time width is less than the third time width.

5. The LED light string control system as claimed in claim 2, wherein the first voltage generation circuit comprises:

a first switch, coupled to the LED light string and the control module, wherein the second voltage generation circuit is connected to the first voltage generation circuit in parallel, and comprises:

a first regulation component, coupled to the LED light string, and a second switch, coupled to the first regulation component and the control module, wherein the control module turns on the first switch to make a ground voltage as the first voltage so that a DC voltage received by the LED light string is used as the first voltage level; the first regulation component generates the second voltage due to the turned-on second switch controlled by the control module so as to change the signal to the second voltage level that is equal to the DC voltage minus the second voltage.

6. The LED light string control system as claimed in claim 2, wherein the first voltage generation circuit comprises:

a first switch, coupled to the LED light string and the control module, wherein the second voltage generation circuit comprises:

a first voltage generation module, coupled to a node between the LED light string and the first switch, and a first unidirectional conduction component, coupled to the node and the first voltage generation module, and configured for unidirectional conduction of a path from the node to the first voltage generation module, wherein the control module turns on the first switch to make a ground voltage as the first voltage so that a DC voltage received by the LED light string is used as the first voltage level; the control module controls the first voltage generation module to generate the second voltage so as to change the signal to the second voltage level that is equal to the DC voltage minus the second voltage.

7. A method of controlling an LED light string control system, the method comprising steps of:

changing a signal received by an LED light string to a first voltage level according to a first logic of a light command, changing the signal to a second voltage level according to a second logic of the light command, changing the signal to the second voltage level as a distinction voltage level for distinguishing two consecutive first voltage levels once first logics of the light command appear consecutively, and/or changing the signal to the first voltage level as the distinction voltage level VI for distinguishing two consecutive second voltage levels once second logics of the light command appear consecutively, and generating a drive command, by at least one LED module of the LED light string, corresponding to the plurality of first voltage levels and the plurality of second voltage levels except the distinction voltage levels so as to generate lighting behavior according to the drive command, wherein the light command is composed of the plurality of first logics and the plurality of second logics; the distinction voltage level has a first time width, the first voltage level has a second time width, and the second voltage level has a third time width; the first time width is different from the second time width and the third time width.

8. The method of controlling the LED light string control system as claimed in claim 7, further comprising steps of:

providing a first voltage to change the signal to the first voltage level, and providing a second voltage to change the signal to the second voltage level.

9. The method of controlling the LED light string control system as claimed in claim 8, further comprising steps of:

limiting a first time width of the distinction voltage level to be less than a second time width of the first voltage level, and limiting the first time width to be less than a third time width of the second voltage level.

10. The method of controlling the LED light string control system as claimed in claim 8, further comprising steps of:

using a ground voltage as the first voltage to use a DC voltage received by the LED light string as the first voltage level, and changing the signal to the second voltage level that is equal to the DC voltage minus the second voltage.

* * * * *